US007030399B2

(12) United States Patent
Williamson et al.

(10) Patent No.: US 7,030,399 B2
(45) Date of Patent: Apr. 18, 2006

(54) CLOSURE FOR SHIELDING THE TARGETING ASSEMBLY OF A PARTICLE ACCELERATOR

(75) Inventors: Andrew C. Williamson, Knoxville, TN (US); Charles W. Alvord, Farragut, TN (US); Ron E. Pevey, Knoxville, TN (US)

(73) Assignee: CTI Molecular Imaging, Inc., Knoxville, TN (US)

( * ) Notice: Subject to any disclaimer, the term of this patent is extended or adjusted under 35 U.S.C. 154(b) by 0 days.

(21) Appl. No.: 10/815,246

(22) Filed: Mar. 31, 2004

(65) Prior Publication Data

US 2005/0218347 A1 Oct. 6, 2005

(51) Int. Cl.
*G21F 7/05* (2006.01)

(52) U.S. Cl. ..... 250/515.1; 250/492.3

(58) Field of Classification Search ..... 250/492.3, 250/515.1, 517.1, 518.1; 315/500, 501, 502, 315/503, 504, 505, 506, 507; 376/287, 288
See application file for complete search history.

(56) References Cited

U.S. PATENT DOCUMENTS

| | | | | |
|---|---|---|---|---|
| 4,074,141 | A * | 2/1978 | Bryant | 250/517.1 |
| 4,801,423 | A * | 1/1989 | Warren et al. | 376/287 |
| 5,037,602 | A | 8/1991 | Dabiri et al. | |
| 5,482,865 | A | 1/1996 | Ferrieri et al. | |
| 5,874,811 | A | 2/1999 | Finlan et al. | |
| 6,392,246 | B1 | 5/2002 | Wiberg et al. | |
| 6,433,495 | B1 | 8/2002 | Wiberg | |
| 2002/0060300 | A1 * | 5/2002 | O'kane et al. | 250/515.1 |

* cited by examiner

*Primary Examiner*—Jack I. Berman

(57) ABSTRACT

A closure (10) for shielding, and selectively providing access to, the targeting assembly of a particle accelerator of a radioisotope production system. The closure (10) includes at least one, and in one embodiment, first and second doors (44, 46), for selectively covering an opening in the housing of the particle accelerator which provides access to the targeting assembly. A door mounting assembly is also provided for mounting the first and second doors (44, 46) on the housing of the particle accelerator. In one embodiment the door mounting assembly includes a frame (30) for being secured about the opening in the particle accelerator accessing the targeting assembly. Further, in one embodiment the frame (30) and first and second doors (44, 46) are fabricated of copper.

40 Claims, 5 Drawing Sheets

CLOSURE FOR SHIELDING THE TARGETING ASSEMBLY OF A PARTICLE ACCELERATOR

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to radiation shielding for the targeting assembly of a cyclotron or particle accelerator used in a radiopharmaceutical or radioisotope production system. More specifically, the present invention is related to a closure which is mounted on the housing of a particle accelerator or cyclotron, and which serves as radiation shielding for, and provides access to, such targeting assembly.

2. Description of the Related Art

Positron Emission Tomography (PET) is a powerful diagnostic tool which allows the imaging of biological functions and physiology. PET utilizes short-lived radioactive isotopes, commonly referred to as tracers, which are injected into a patient's body. These radioisotopes are produced by radioisotope production systems which incorporate particle accelerators or cyclotrons. The particle accelerators produce radioisotopes by accelerating a particle beam and bombarding a target material. The typical particle accelerator used for producing PET radioisotopes includes a targeting assembly which is accessible from outside of the housing of the accelerator, and generally through an access opening in the housing, such that the target material can be replaced and such that maintenance can be performed on the targeting assembly. In order to protect those operating and maintaining the accelerator from the radiation emanating from the accelerator, the entire accelerator is placed in a shielded enclosure. For example, such shielded enclosures often take the form of a shell which surrounds the accelerator or cyclotron, with the shell being provided with movable portions or doors to provide access to the accelerator. The shielded enclosures typically include a high-Z shielding material, such as lead, adjacent the accelerator to moderate neutron energy and shield against gamma radiation, and a low-Z outer shielding, such as concrete, to absorb neutrons and, again, to provide gamma shielding. Commonly, the high-Z shielding defines a greater thickness proximate the targeting system of the accelerator given the neutron energy typically emanating therefrom. Generally, such shielded enclosures provide the only shielding about the targeting assembly of the accelerator such that when the shielded enclosures are removed or opened the targeting assemblies are accessible, but unshielded. Further, typical shielding enclosures for particle accelerators have a gap greater than one, inch (>1") between the shielding and the accelerator/target assembly. This is due to the manufacturing tolerances of the shielding materials involved, and the methods for shield motion. Neutrons can be transported through these gaps without being moderated, allowing higher radiation doses outside the shield assembly.

An example of one approach to providing shielding for an accelerator used in conjunction with a radioisotope production system is disclosed in U.S. Pat. No. 6,392,246 B1. The apparatus disclosed therein provides an outer housing which shields not only the accelerator, but various other components of the radioisotope production system. Further, U.S. Pat. No. 5,037,602 discloses a radioisotope production facility, and discusses the need for thick shielding around the accelerator to confine radiation. See also, U.S. Pat. Nos. 6,433,495 B1; 5,874,811; 5,482,865; and 4,646,659.

Radioisotope production systems are commonly located in hospitals and other healthcare facilities such that the radioisotopes are readily available for use in medical imaging. Accordingly, it is imperative that proper radiation shielding be provided to protect not only the operators of the system and the medical staff, but the public. However, the need for thick radiation shielding around the accelerator tends to make radioisotope production systems large, space consuming systems, and the shielding tends to be very heavy. The size and weight of the radioisotope production systems tends to limit the nature of the facilities in which the systems can be placed, and often the construction of special facilities to accommodate the systems is necessary. Thus, it is advantageous to limit the thickness of the shielding surrounding the accelerator to the extent that it can be done without compromising the effectiveness of the shielding. Further, particularly where the radioisotope production system is placed in a healthcare facility, the exposure of the targeting system when the shielded enclosure surrounding the accelerator is removed can be particularly problematic. For example, where access to components of the accelerator other than those associated with the targeting system is required, the removal or the opening of the shielded enclosure leaves the targeting system unshielded, thereby unnecessarily increasing the level of radiation emanating from the accelerator. Additionally, it is advantageous to make shielding that conforms more closely to the accelerator and target envelope, to force the moderation of initially energetic neutrons.

BRIEF SUMMARY OF THE INVENTION

The present invention provides a closure for shielding, and selectively providing access to, the targeting assembly of the particle accelerator of a radioisotope production system. The typical radioisotope production system which utilizes the closure of the present invention includes a shielded enclosure which surrounds the particle accelerator and provides selective access to the particle accelerator. The closure of the present invention includes at least one door, and in one embodiment first and second doors, for selectively covering the opening in the housing of the particle accelerator. This closure, by virtue of being mounted directly on the accelerator, has a much smaller gap (<⅛") between the shielding material of the closure and the accelerator, forcing the moderation of neutrons. This makes the additional shielding more effective, and, therefore, smaller and lighter than would otherwise be possible. The doors are movable from a closed position whereby the targeting assembly is shielded, to an open position whereby access to the targeting assembly is provided. In one embodiment, each first and second door is fabricated of copper. The closure also includes a door mounting assembly for mounting the doors on the housing of the particle accelerator. In one embodiment the door mounting assembly includes a frame for being secured about the opening in the particle accelerator accessing the targeting assembly. The door mounting assembly also including a first hinge assembly for pivotally securing the first door to the frame and a second hinge assembly for pivotally securing the second door to the frame, whereby the first and second doors of the closure selectively cover, and reduce radiation emissions from, the opening in the housing of the particle accelerator and the targeting assembly therein. Thus, the particle accelerator can be accessed by opening or removing the shielded enclosure surrounding the accelerator while maintaining radiation shielding over the targeting assembly.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
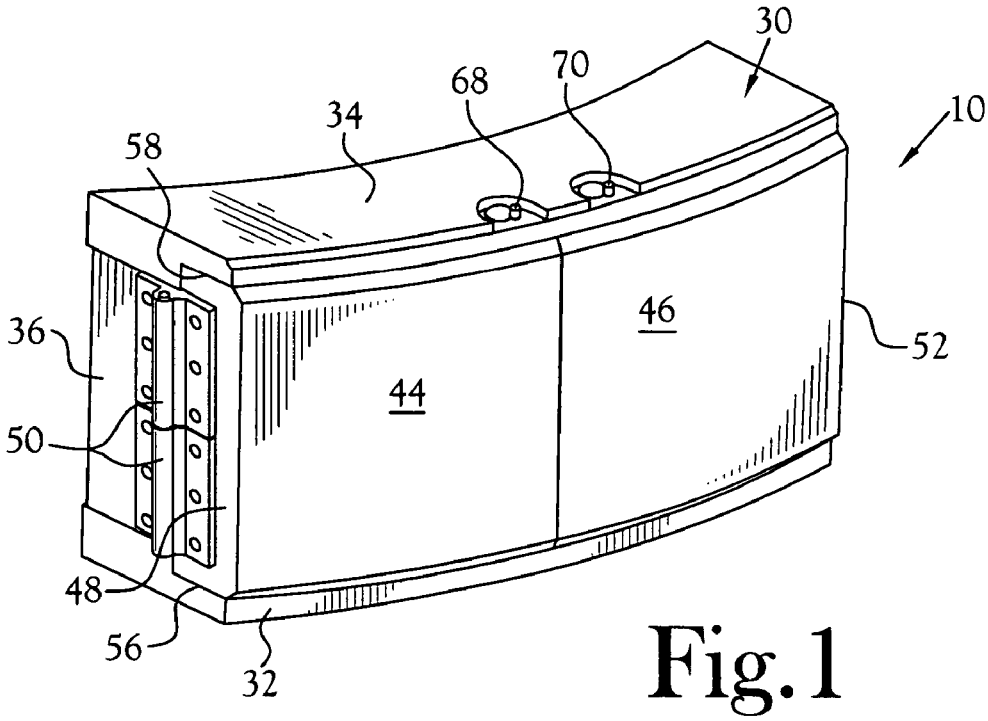
FIG. 1 is a perspective view of a closure for shielding the targeting assembly of a particle accelerator in accordance with the present invention.
Figure 2:
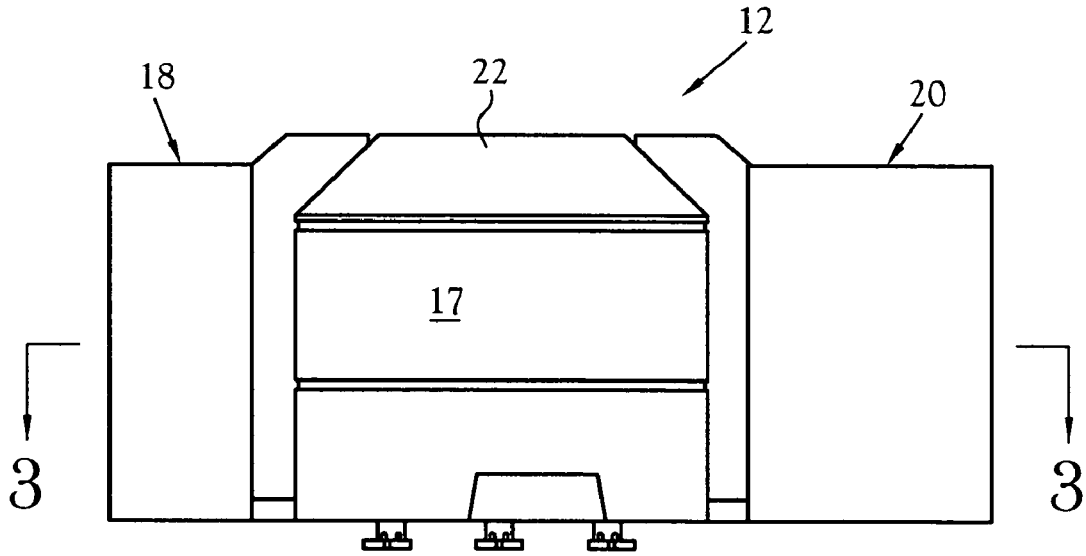
FIG. 2 is a side elevation view of a radioisotope production system of the type that would utilize the closure of the present invention.
Figure 3:
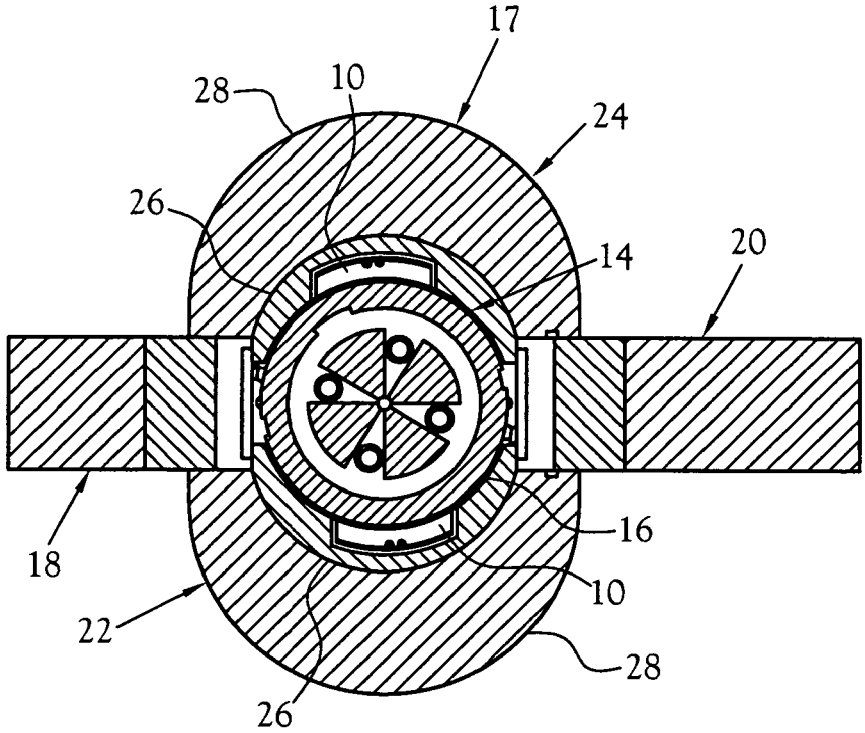
FIG. 3 is a top plan view, in section taken at 3—3 of FIG. 2, of a radioisotope production system with two closures in accordance with the present invention mounted on the particle accelerator.
Figure 4:
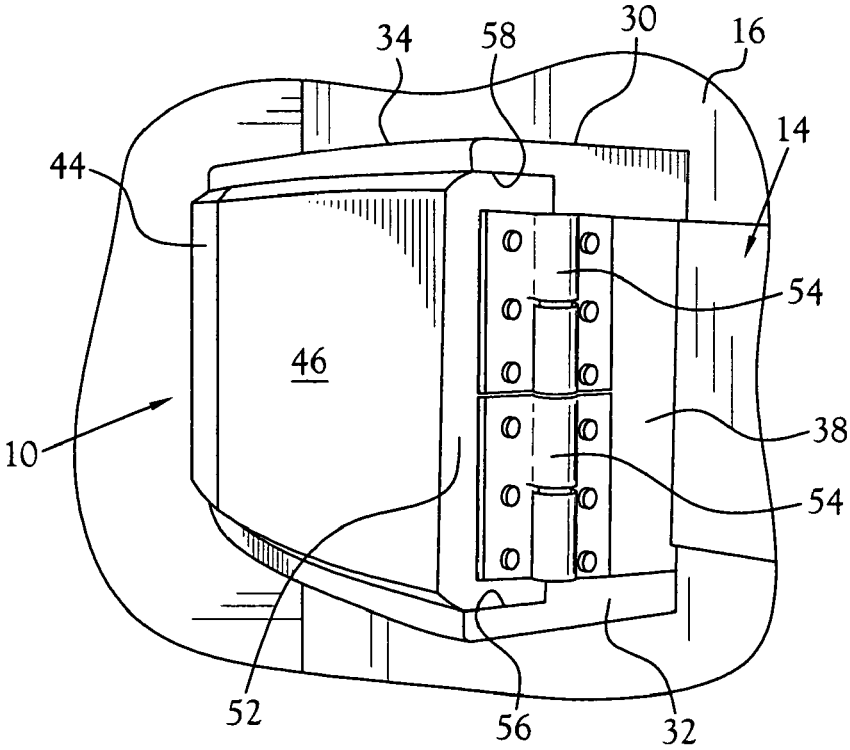
FIG. 4 is a perspective view of a closure for shielding the targeting assembly of a particle accelerator in accordance with the present invention.

A closure for shielding, and selectively providing access to, the targeting assembly of a particle accelerator in accordance with the present invention is illustrated generally at 10 in FIGS. 1, 3–5 and 7. The closure 10 is used to shield the target assembly of the particle accelerator of a radioisotope production system. An example of a typical radioisotope production system of the type which would utilize the closure 10 is illustrated at 12 in FIGS. 2 and 3. As illustrated in FIG. 3, the radioisotope production system 12 incorporates a particle accelerator 14 enclosed in a housing 16, and includes a shielded enclosure 17 which surrounds the accelerator 14. In this particular system 12 the shielded enclosure 17 includes stationary shield assemblies 18 and 20 which are provided on opposite sides of the accelerator 14, and includes oppositely disposed movable shield assemblies 22 and 24 which can be moved away from the accelerator 14 to provide access to the accelerator. However, the particle accelerators with which the closure 10 can be used may utilize various shield enclosure configurations. Further, the illustrated particle accelerator 14 incorporates two target changers, and, accordingly, two closures 10 are utilized. It will, however, be understood that the closure 10 can be utilized with particle accelerators having single or multiple targeting assemblies. It will also be noted that the movable shield assemblies 22 and 24 include an inner shield 26 of high-Z shielding material, such as, for example, lead epoxy, and an outer shield 28l of low-Z shielding material, such as, for example, concrete.

The closure 10 is provided with a door mounting assembly which, as will be discussed in detail below, facilitates the mounting of one or more doors for accessing the targeting assembly of an accelerator. As best illustrated in FIGS. 1 and 4 through 6, in one embodiment the door mounting assembly includes a frame 30 which is defined by a sill member 32, a header member 34, and opposite jamb members 36 and 38. The frame 30 is secured to the housing 16 of the particle accelerator 14 about an opening 40 (see FIG. 6) provided in the housing 16 through which the targeting assembly 42 of the accelerator 16 is accessed. The sill member 32, header member 34, and jamb members 36 and 38, are provided with counter sunk openings 39 which extend through the frame 30 and allow the frame 30 to be bolted to the housing 16 of the accelerator 14 with suitable bolts (not shown). As will be discussed further below, the frame 30 is fabricated from a suitable radiation shielding material. In one embodiment the shielding material used is copper, but other materials could be used.

Mounted on the frame 30 is at least one closable door, and in the illustrated embodiment two doors 44 and 46 are mounted on the frame 30 such that the opening defined by the frame 30 can be selectively closed. The door 44 is pivotally secured to the frame 30 at its outboard edge 48 with a hinge assembly 50, and the door 46 is pivotally secured to the frame 30 at its outboard edge 52 with a further hinge assembly 54. The various components of the hinge assemblies 50 and 54 are fabricated of a strong, durable material, such as, for example, steel. As will be discussed further below, the doors 44 and 46 are fabricated from a suitable radiation shielding material, and in one embodiment the shielding material used is copper. However, other radiation shielding materials could be used. Moreover, it is contemplated that alternative door mounting assemblies could be used to mount the doors 44 and 46 on the particle accelerator instead of the frame 30. For example, the doors 44 and 46, or a single door, could be mounted directly on the housing 16 of the particle accelerator 14 using suitable hinge assemblies.

Figure 9:
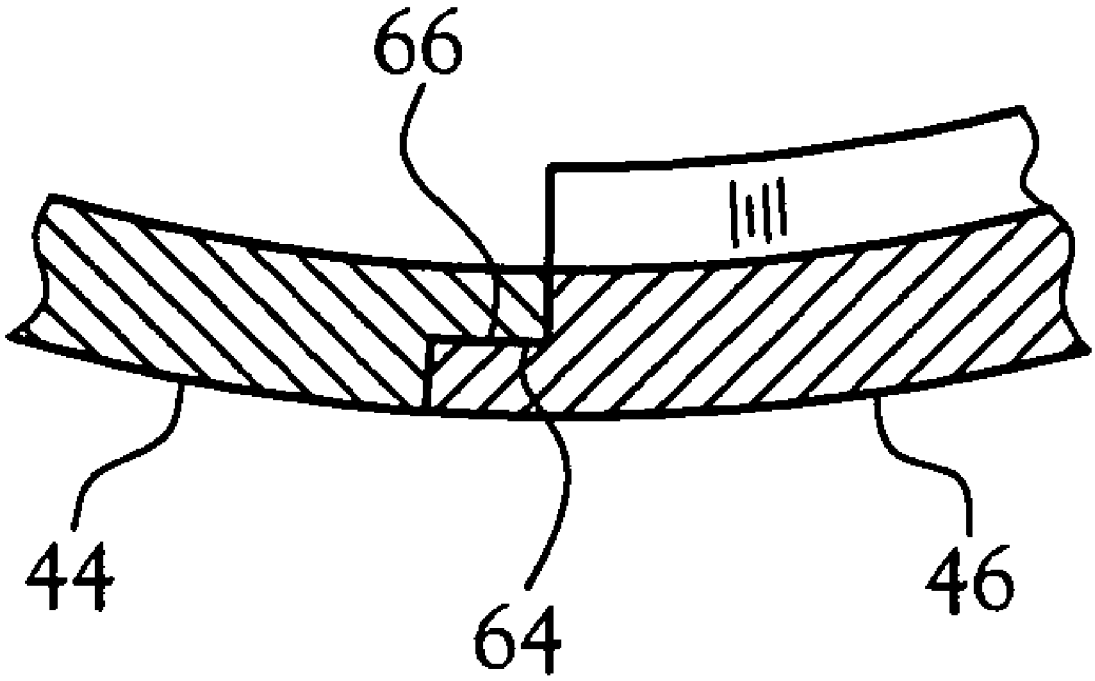
FIG. 9 is a partial top plan view, in section, of the doors of a closure for shielding the targeting assembly of a particle accelerator in accordance with the present invention.

In the illustrated embodiment, the sill member 32 defines a rabbet 56 along the upper portion of its front edge. The rabbet 56 receives the lower inner edge portions of the doors 44 and 46 when such doors are in a closed position. Also, the header member 34 defines a rabbet 58 along the lower portion of its front edge which receives the lower inner edge portions of the doors 44 and 46 when such doors are in a closed position. Further, the doors 44 and 46 are mounted such that they close over the front surfaces 60 and 62 of the jamb members 36 and 38, respectively. It will also be noted, as illustrated in FIG. 9, that the door 44 is provided with a rabbet 64 along the outside of its inboard edge, and the door 46 is provided with a rabbet 66 along the inside of its inboard edge, such that when the doors 44 and 46 are in a closed position the doors overlap proximate their inboard edges. Also, it will be noted that the sill member 32, the header member 34, and the jamb members 36 and 38 are matched dimensionally to the accelerator 14 and housing 16, providing substantially no gaps for radiation to emanate from or through. As a consequence of the use of the rabbets 56, 58, 64 and 66, and the positioning of the doors 44 and 46 over the front surfaces 60 and 62 of the jamb members 36 and 38, any radiation emanating from the targeting assembly 42, or the opening 40 in the housing 16, is intercepted by the radiation shielding material from which the doors 44 and 46, and the frame 30, are fabricated, and there are no openings or seams between the frame 30 and the doors 44 and 46 which would offer an unobstructed linear radiation path exiting the closure 10.

The closure 10 is also provided with a locking mechanism which selectively secures the doors 44 and 46 in a closed position. It will be recognized by those of ordinary skill in the art that various locking mechanisms could be used, such as, for example, various latch or bolt mechanisms typically used to secure doors. However, in one embodiment the securing mechanism includes a pair of removable securing pins 68 and 70, which are received through holes 72 and 74 in the header member 34. The holes 72 and 74 register with holes in the doors 44 and 46 (only one such hole being shown at 76 in FIG. 8) when such doors are in a closed position. Accordingly, the doors 44 and 46 can being selectively secured in the closed position by inserting the pins 68 and 70 through the holes 72 and 74 in the header member 34, and into the holes 76 in the doors 44 and 46. To facilitate the removal of the pins 68 and 70, such pins are provided with pull rings 71.

Figure 5:
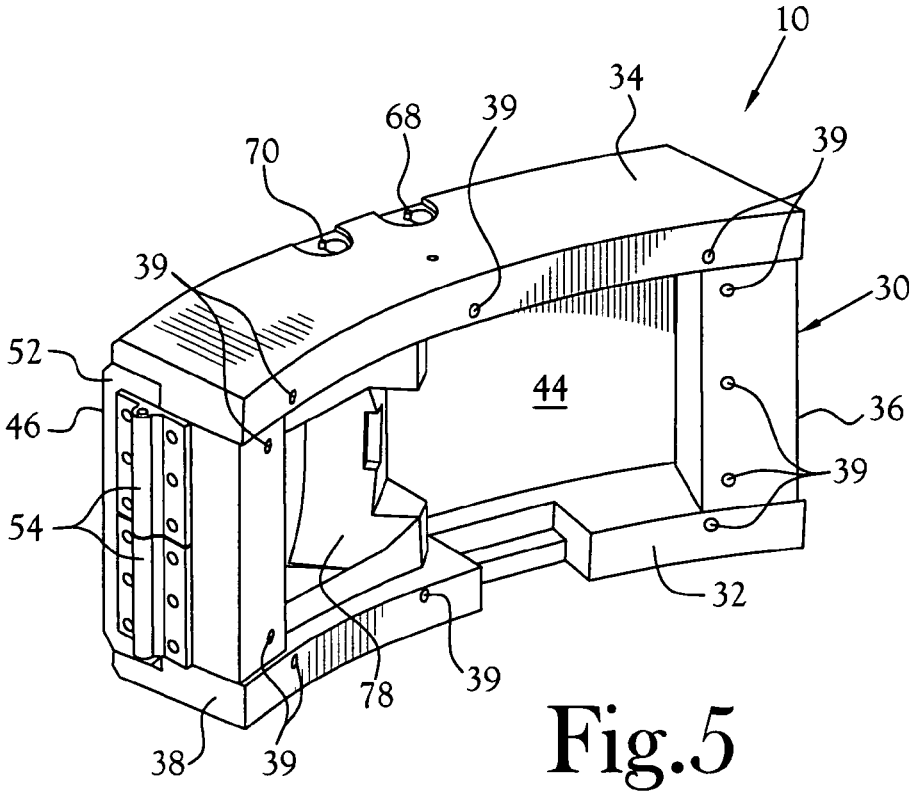
FIG. 5 is a rear perspective view of a closure for shielding the targeting assembly of a particle accelerator in accordance with the present invention.
Figure 6:
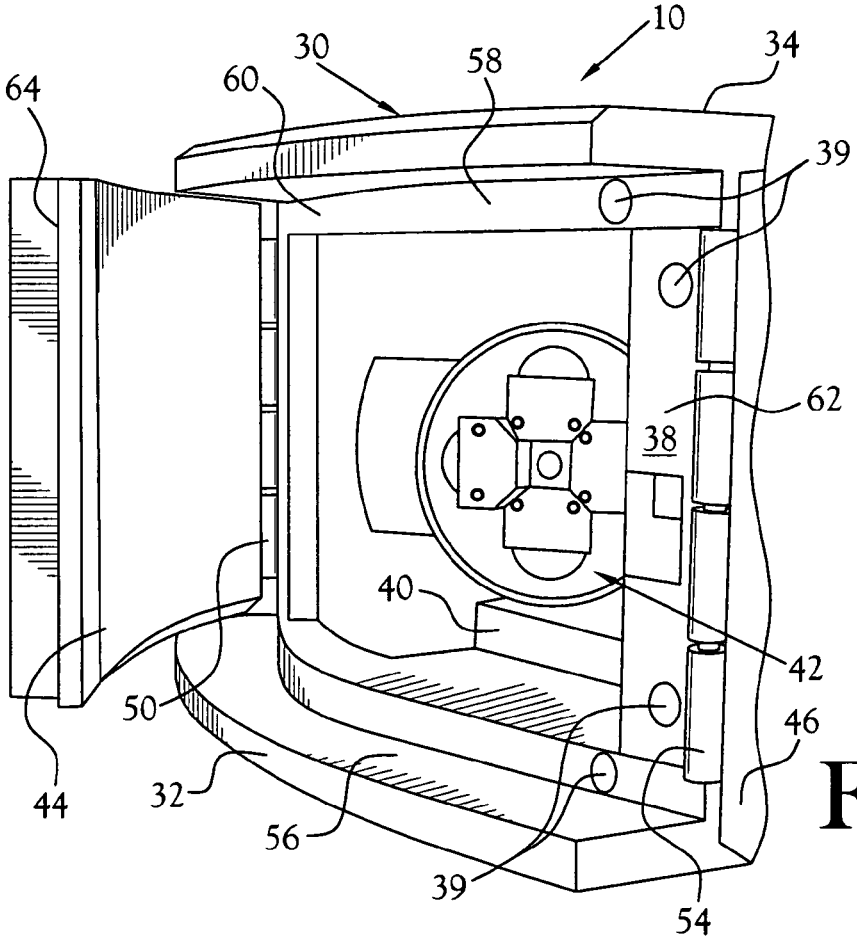
FIG. 6 is a partial perspective view of a closure for shielding the targeting assembly of a particle accelerator in accordance with the present invention.
Figure 7:
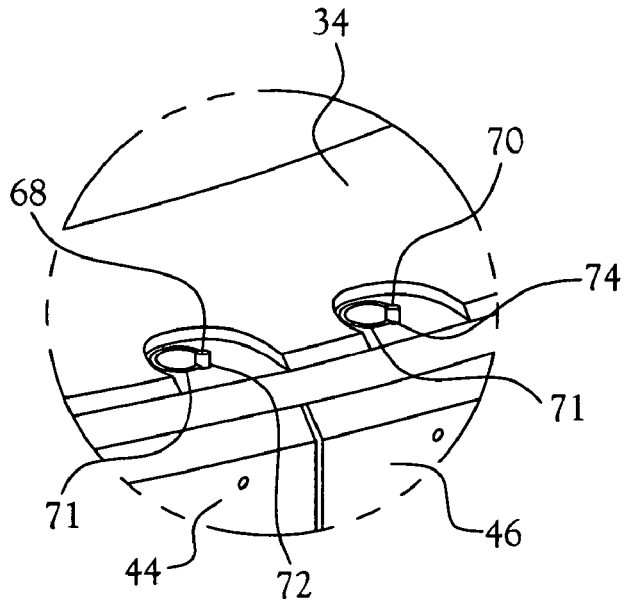
FIG. 7 is a partial perspective view of a closure for shielding the targeting assembly of a particle accelerator in accordance with the present invention.
Figure 8:
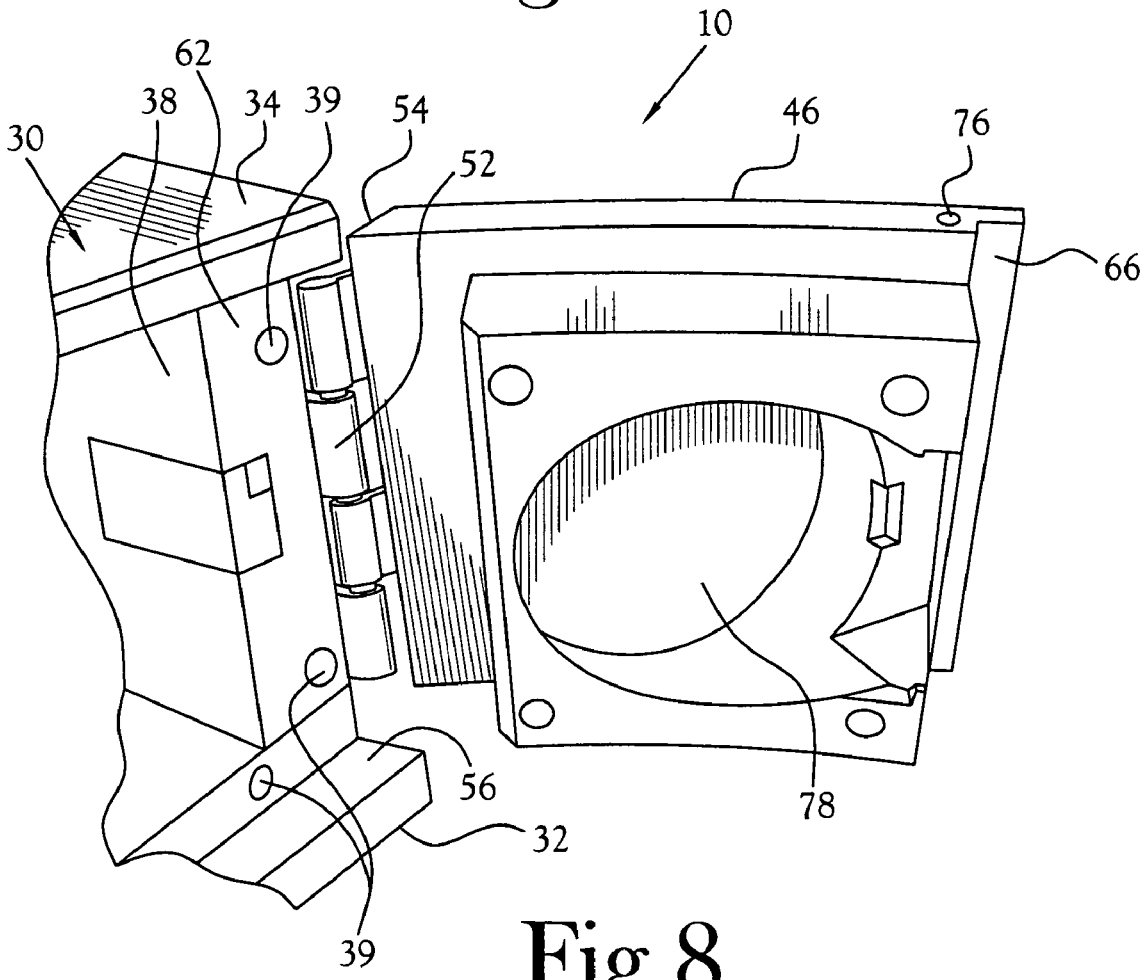
FIG. 8 is a partial perspective view of a closure for shielding the targeting assembly of a particle accelerator in accordance with the present invention.

It is also anticipated that one or both of the doors 44 and 46 of the closure 10 can be provided with contoured inner surfaces which are configured to be closely received over components of the targeting assembly of the particular particle accelerator. For example, as illustrated in FIGS. 5 and 8, the door 46 is provided with an inner surface which defines a recess 78 which closely receives components of the targeting assembly 42.

As noted above, in one embodiment the frame 30 and doors 44 and 46 of the closure 10 are made from copper. In this regard, testing has disclosed that the use of copper for such components of the closure 10 permits the thickness of the inner shield 26 of the shielded enclosure 17 to be reduced. For example, in tests to determine the desired relative thickness of the copper shielding material of the closure 10 and the lead epoxy shielding 26 of the shielded enclosure 17 necessary to maintain a 0.25 mrem/hr target radiation dose, the following results were obtained:

| Copper Thickness (cm) | Lead Epoxy Thickness (cm) |
|---|---|
| 0 | 40 |
| 2 | 35 |
| 4 | 30 |
| 6 | 26 |
| 8 | 23 |
| 10 | 20 |

Accordingly, whereas 40 cm of lead epoxy was required to maintain the target dose, by adding 10 cm of copper shielding over the target assembly, the thickness of the lead epoxy shielding could be reduced to 20 cm, reducing the combined thickness of the copper and lead epoxy shielding to 30 cm. Thus, whereas the thickness of the various components of the closure 10 can vary, it will be understood that the use of copper as the fabricating material for the closure 10 allows the combined thickness of the shielding for the accelerator to be reduced, allowing a reduction in the size of the radioisotope production system. This notwithstanding, it is contemplated that various other fabricating materials can be used for the components of the closure 10, such as, for example, stainless steel, lead, or aluminum, and it is contemplated that various alloys of copper could be used. Moreover, it is contemplated that the doors 44 and 46 could incorporate, and the frame 30, could incorporate layers of copper, or copper alloy, shielding rather than being fabricated entirely of copper, or a copper alloy.

In light of the above, it will be recognized that the closure 10 provides a separate shielding for the targeting assembly 42 of the accelerator 14, while still allowing access to the targeting assembly. When the shielded enclosure 17 is opened, as in when the movable shield assemblies 22 and 24 are moved away from the accelerator 14, the targeting assembly 42 remains shielded by the closure 10. Accordingly, where access to the accelerator 14 is required, but not to the targeting assembly 42, the doors of the closure 10 can remain closed in order to reduce radiation emissions. Moreover, the use of a closure 10 fabricated of copper, or a copper alloy, permits the thickness of shielded enclosure 17 surrounding the accelerator to be reduced, thereby allowing the radioisotope production system 12 to be smaller in size.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, we claim:

1. A closure for shielding, and selectively providing access to, the targeting assembly of a particle accelerator, the particle accelerator including a housing defining an opening for accessing the targeting assembly, the particle accelerator being surrounded by an outer shielded enclosure providing selective access to the particle accelerator, said closure being adapted to be mounted on said housing and comprising at least a first door for selectively covering the opening in the housing of the particle accelerator, and said closure including a door mounting assembly for mounting said first door on the housing of the particle accelerator, whereby said first door of said closure selectively covers the opening in the housing of the particle accelerator when access to the particle accelerator through the outer shielded enclosure is provided.

2. The closure of claim 1 wherein said first door includes copper radiation shielding.

3. The closure of claim 1 wherein said door mounting assembly includes at least a first hinge assembly to facilitate pivotally mounting said first door on the housing of the particle accelerator.

4. The closure of claim 1 wherein said door mounting assembly includes a frame for being mounted on the housing of the particle accelerator and received about the opening in the housing of the particle accelerator and for supporting said door.

5. The closure of claim 4 wherein said door mounting assembly includes at least a first hinge assembly for pivotally mounting said door to said frame.

6. The closure of claim 4 wherein said frame and said door include copper shielding material.

7. The closure of claim 4 wherein said frame and said door are fabricated substantially of copper.

8. The closure of claim 1 wherein said door mounting assembly includes a frame for being received about the opening in the housing of the particle accelerator, said frame including a sill member, a header member, and first and second jamb members, said door mounting assembly also including at least a first hinge assembly for pivotally mounting said door on said frame, whereby said first door is movable from a closed position to an open position.

9. The closure of claim 8 wherein said closure further comprises a second door, and said door mounting assembly includes a second hinge assembly for pivotally mounting said second door on said frame, whereby said second door is movable from a closed position to an open position.

10. The closure of claim 9 wherein each said first and second door is substantially rectangular and defines outboard and inboard edges, and upper and lower edges, and wherein said each said first and second jamb member defines a front surface, said outboard edge of said first door being pivotally secured to said first sill member with said first hinge assembly such that said first door covers said front surface of said first jamb member when said first door is in said closed position, and said outboard edge of said second door being pivotally secured to said second sill member with said second hinge assembly such that said second door covers said front surface of said second jamb member when said second door is in said closed position.

11. The closure of claim 10 wherein said sill member of said frame defines a first rabbet along an upper forward edge of said sill member for receiving said lower edges of said first and second doors when said first and second doors are in said closed position, and wherein said header member of said frame defines a second rabbet along a lower forward edge of said header member for receiving said upper edges of said first and second doors when said first and second doors are in said closed position.

12. The closure of claim 11 wherein said first door defines a third rabbet along the inside of said inboard edge of said first door, and wherein said second door defines a fourth rabbet along the outside of said inboard edge of said second door, whereby said inboard edges of said first and second doors overlap when said first and second doors are in said closed position.

13. The closure of claim 12 wherein said first and second doors and said frame are fabricated substantially of copper.

14. A closure for shielding, and selectively providing access to, the targeting assembly of a particle accelerator, the particle accelerator including a housing defining an opening for accessing the targeting assembly, the particle accelerator being surrounded by an outer shielded enclosure providing selective access to the particle accelerator, said closure comprising:

first and second doors for selectively covering the opening in the housing of the particle accelerator, each said first and second door being movable from a closed position whereby the targeting assembly is shielded to an open position, whereby access to the targeting assembly is provided, and a door mounting assembly for mounting said first and second doors on the housing of the particle accelerator, said door mounting assembly including a frame for being secured about the opening in the particle accelerator accessing the targeting assembly, said door mounting assembly also including a first hinge assembly for pivotally securing said first door to said frame and a second hinge assembly for pivotally securing said second door to said frame, whereby said first and second doors of said closure selectively cover, and reduce radiation emissions from, the opening in the housing of the particle accelerator and the targeting assembly therein when access to the particle accelerator through the outer shielded enclosure is provided.

15. The closure of claim 14 wherein said first and second doors are fabricated substantially of copper.

16. The closure of claim 15 wherein said frame is fabricated substantially of copper.

17. The closure of claim 14 wherein said frame includes a sill member, a header member, and first and second jamb members.

18. The closure of claim 17 wherein each said first and second door is substantially rectangular and defines outboard and inboard edges, and upper and lower edges, and wherein said each said first and second jamb member defines a front surface, said outboard edge of said first door being pivotally secured to said first sill member with said first hinge assembly such that said first door covers said front surface of said first jamb member when said first door is in said closed position, and said outboard edge of said second door being pivotally secured to said second sill member with said second hinge assembly such that said second door covers said front surface of said second jamb member when said second door is in said closed position.

19. The closure of claim 18 wherein said sill member of said frame defines a first rabbet along an upper forward edge of said sill member for receiving said lower edges of said first and second doors when said first and second doors are in said closed position, and wherein said header member of said frame defines a second rabbet along a lower forward edge of said header member for receiving said upper edges of said first and second doors when said first and second doors are in said closed position.

20. The closure of claim 19 wherein said first door defines a third rabbet along the inside of said inboard edge of said first door, and wherein said second door defines a forth rabbet along the outside of said inboard edge of said second door, whereby said inboard edges of said first and second doors overlap when said first and second doors are in said closed position.

21. The closure of claim 20 wherein said closure further comprises a locking mechanism for securing said first and second doors in said closed position.

22. The closure of claim 21 wherein said locking mechanism includes a first and second securing pins, said first securing pin being releasably received through a hole in said header member, and releasably received in a hole provided in said first door, and said second securing pin being releasably received through a further hole in said header member, and releasably received in a hole provided in said second door.

23. A closure for shielding, and selectively providing access to, the targeting assembly of a particle accelerator, the particle accelerator including a housing defining an opening for accessing the targeting assembly, the particle accelerator being surrounded by a shielded enclosure providing selective access to the particle accelerator, said closure comprising:

first and second doors for selectively covering the opening in the housing of the particle accelerator, each said first and second door being fabricated substantially of copper and being movable from a closed position whereby the targeting assembly is shielded to an open position whereby access to the targeting assembly is provided, and a door mounting assembly for mounting said first and second doors on the housing of the particle accelerator, said door mounting assembly including a frame for being secured about the opening in the particle accelerator accessing the targeting assembly, said frame being fabricated substantially of copper, said door mounting assembly also including a first hinge assembly for pivotally securing said first door to said frame and a second hinge assembly for pivotally securing said second door to said frame, whereby said first and second doors of said closure selectively cover, and reduce radiation emissions from, the opening in the housing of the particle accelerator and the targeting assembly therein when access to the particle accelerator is provided through the shielded enclosure.

24. The closure of claim 23 wherein said first door defines an interior surface which is contoured to closely receive components of the targeting assembly of the particle accelerator.

25. The closure of claim 23 wherein each said first and second door is substantially rectangular and defines outboard and inboard edges, and upper and lower edges, and wherein said each said first and second jamb member defines a front surface, said outboard edge of said first door being pivotally secured to said first sill member with said first hinge assembly such that said first door covers said front surface of said first jamb member when said first door is in said closed position, and said outboard edge of said second door being pivotally secured to said second sill member with said second hinge assembly such that said second door covers said front surface of said second jamb member when said second door is in said closed position.

26. The closure of claim 25 wherein said sill member of said frame defines a first rabbet along an upper forward edge of said sill member for receiving said lower edges of said first and second doors when said first and second doors are in said closed position, and wherein said header member of said frame defines a second rabbet along a lower forward edge of said header member for receiving said upper edges of said first and second doors when said first and second doors are in said closed position.

27. The closure of claim 26 wherein said first door defines a third rabbet along the inside of said inboard edge of said first door, and wherein said second door defines a forth rabbet along the outside of said inboard edge of said second door, whereby said inboard edges of said first and second doors overlap when said first and second doors are in said closed position.

28. A closure for shielding, and selectively providing access to, the targeting assembly of a particle accelerator, the particle accelerator including a housing defining an opening for accessing the targeting assembly, the particle accelerator being surrounded by an outer shielded enclosure providing selective access to the particle accelerator, said closure being adapted to be mounted on said housing and comprising at least a first door for selectively covering the opening in the housing of the particle accelerator, and said closure including a door mounting assembly for mounting said first door on the housing of the particle accelerator, whereby said first door of said closure selectively covers the opening in the housing of the particle accelerator when access to the particle accelerator through the outer shielded enclosure is provided, said door defining an interior surface having a contour adapted to be closely received over at least one component of the targeting assembly of the particle accelerator.

29. The closure of claim 28 wherein said first door includes copper radiation shielding.

30. The closure of claim 28 wherein said door mounting assembly includes at least a first hinge assembly to facilitate pivotally mounting said first door on the housing of the particle accelerator.

31. The closure of claim 28 wherein said door mounting assembly includes a frame for being mounted on the housing of the particle accelerator and received about the opening in the housing of the particle accelerator and for supporting said door.

32. The closure of claim 31 wherein said door mounting assembly includes at least a first hinge assembly for pivotally mounting said door to said frame.

33. The closure of claim 31 wherein said frame and said door include copper shielding material.

34. The closure of claim 31 wherein said frame and said door are fabricated substantially of copper.

35. The closure of claim 28 wherein said door mounting assembly includes a frame for being received about the opening in the housing of the particle accelerator, said frame including a sill member, a header member, and first and second jamb members, said door mounting assembly also including at least a first hinge assembly for pivotally mounting said door on said frame, whereby said first door is movable from a closed position to an open position.

36. The closure of claim 35 wherein said closure further comprises a second door, and said door mounting assembly includes a second hinge assembly for pivotally mounting said second door on said frame, whereby said second door is movable from a closed position to an open position.

37. The closure of claim 36 wherein each said first and second door is substantially rectangular and defines outboard and inboard edges, and upper and lower edges, and wherein said each said first and second jamb member defines a front surface, said outboard edge of said first door being pivotally secured to said first sill member with said first hinge assembly such that said first door covers said front surface of said first jamb member when said first door is in said closed position, and said outboard edge of said second door being pivotally secured to said second sill member with said second hinge assembly such that said second door covers said front surface of said second jamb member when said second door is in said closed position.

38. The closure of claim 37 wherein said sill member of said frame defines a first rabbet along an upper forward edge of said sill member for receiving said lower edges of said first and second doors when said first and second doors are in said closed position, and wherein said header member of said frame defines a second rabbet along a lower forward edge of said header member for receiving said upper edges of said first and second doors when said first and second doors are in said closed position.

39. The closure of claim 38 wherein said first door defines a third rabbet along the inside of said inboard edge of said first door, and wherein said second door defines a fourth rabbet along the outside of said inboard edge of said second door, whereby said inboard edges of said first and second doors overlap when said first and second doors are in said closed position.

40. The closure of claim 39 wherein said first and second doors and said frame are fabricated substantially of copper.

* * * * *